United States Patent [19]

Simkus

[11] 3,946,894

[45] Mar. 30, 1976

[54] DRUM CLOSURE

[75] Inventor: Vyto Simkus, Chicago, Ill.

[73] Assignee: American Flange & Manufacturing Co. Inc., New York, N.Y.

[22] Filed: Nov. 11, 1974

[21] Appl. No.: 522,637

[52] U.S. Cl. ..... 220/256; 220/288

[51] Int. Cl.[2] ..... B65D 41/04

[58] Field of Search ..... 220/257, 256, 288

[56] References Cited

UNITED STATES PATENTS

| | | | |
|---|---|---|---|
| 1,982,145 | 11/1934 | Shera | 220/257 |
| 1,997,203 | 4/1935 | Shera | 220/257 |
| 2,147,325 | 2/1939 | Wackman | 220/257 |
| 2,760,671 | 8/1956 | Parish, Jr. | 220/257 |

*Primary Examiner*—William Price
*Assistant Examiner*—Joseph M. Moy

[57] ABSTRACT

A closure for light gage steel drums made up of an internally threaded closure flange mechanically secured within a suitably formed container wall opening. The flange is formed with a cylindrical neck internally threaded throughout its lower extent and surrounded exteriorly by a polygonally shaped base. A resilient sealing gasket tightly surrounds the flange neck at its juncture with the flange base. A perforated drum stock section is formed to overlie and closely surround the flange neck and base in an improved torque-resisting manner with the upper end of the flange neck beaded outwardly over the surrounding drum stock. The closure is completed with the threaded engagement of a closure plug and application of an overlying tamper-resisting drum seal.

4 Claims, 4 Drawing Figures

DRUM CLOSURE

BACKGROUND OF THE INVENTION

A considerable effort has been expended in the steel container industry to reduce the cost of materials employed in the manufacture of steel drums used principally for the shipping and storage of industrial products. Any reduction in the container wall thickness is, of course, viewed as a substantial saving. There are certain areas of the drum construction, however, where the wall strength becomes quite critical. One such area of criticality is that section of the container wall immediately surrounding the drum closure which is permanently inserted within the drum wall.

This closure, in many instances, consists of a steel bushing or flange having an internally threaded cylindrical neck with a resilient sealing gasket therearound and having a laterally extending polygonal base surrounding its lowermost end. A perforated container wall section overlies the flange neck and base with the upper unthreaded portion of the flange neck beaded outwardly over the surrounding drum stock so as to permanently secure the flange in place. The closure is completed with the threaded engagement of a closure plug and application of an overlying tamper-resisting drum seal. It can be readily appreciated that as the rigidity of the drum stock immediately surrounding the closure flange is diminished, all things being equal, a consequent reduction in resistance to turning torque between the flange and drum stock results. As high torque resistance for proper seating and unseating of the closure plug is essential to good closure performance, various attempts have been made to improve the torque characteristic on flange insertions in light gage drums. Heretofore, these attempts, in large part, have been directed toward the provision of suitable reinforcing collars designed to overlie the drum stock section immediately surrounding the flange in order to achieve the necessary strength. This approach, though functionally adequate, introduces an additional undesirable cost factor.

The instant invention, as hereinafter disclosed, seeks to achieve the necessary degree of torque resistance in the closure container wall joint without resort to additional reinforcing parts and their attendant costs. This has been accomplished by forming the drum stock so as to surround and closely overlie the flange neck and base and also extend well below the outer exposed edge of the flange base. This drum stock formation causes the periphery of the flange base to be completely embedded in the drum stock embossment so that only after severe distortion of the embossment can relative rotational movement between the flange and container wall take place. This specific formation of the drum stock about the flange base, coupled with other features of the invention to be described hereinafter, has given rise to a distinct improvement in the drum closure field and particularly in improving the torque-resistance characteristic of flange insertions in light gage drums.

It is, accordingly, a primary object of the invention to provide a new and improved threaded closure construction for light gage steel drums.

Another object is to provide a new and improved flange insertion in light gage drums having superior torque resistance characteristics.

Another object is to provide a closure for light gage drums wherein the sealing efficiency of the flange gasket is protected against the deleterious effect of elevated temperatures commonly encountered in the curing of drum coatings.

A further object is to provide a drum closure construction including an overlying drum seal having improved tamper-resisting effectiveness.

Other and more detailed objects will in part be obvious and in part pointed out as the description of the invention taken in conjunction with the accompanying drawing proceeds.

Figure 1:
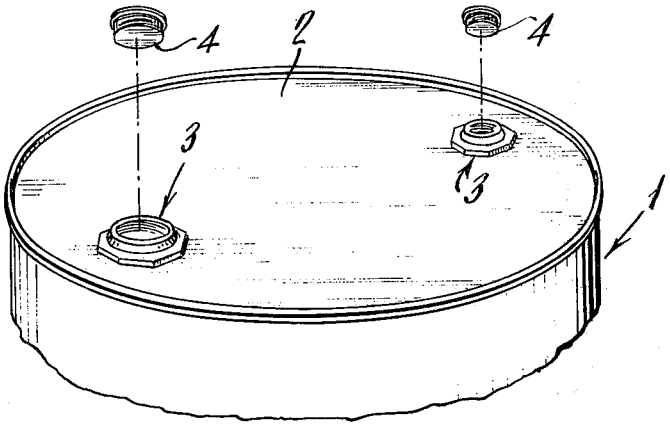
FIG. 1 is an exploded perspective view of a steel drum incorporating the closure combination of the invention.

Considering first the overall environment of the invention, FIG. 1 shows a 55-gallon steel drum 1, such as commonly used for the shipping and storage of industrial liquid products as a nonlimiting example. In the particular drum construction illustrated, the drum head 2 is provided with a pair of threaded closures 3 to facilitate filling and dispensing of the drum contents. Normally, the two closures vary in dimension, one being designated as a 50mm size and the other a 20mm size, but both having essentially the same construction.

Turning to the construction of the drum closure assembly in greater detail, a closure bushing or flange 5 is provided with an upstanding neck 6 having an outer cylindrical surface 7 and an internal screw thread 8 for threaded reception of a closure plug 4. The lowermost end of the neck 6 is surrounded by a laterally extending polygonally shaped base 9 having a bottom surface 10 and a top surface 11 joined to the neck outer surface 7 at the internal corner 12. The base outer edge indicated at 13 is formed in the shape of an octagon having eight flats 14 and eight points 15. An upper corner 16 and lower corner 17 are formed at the juncture of the base edge 13 with the upper and lower base surfaces respectively. A resilient sealing gasket 18 surrounds the lower end of the flange neck at the internal corner 12.

Figure 3:
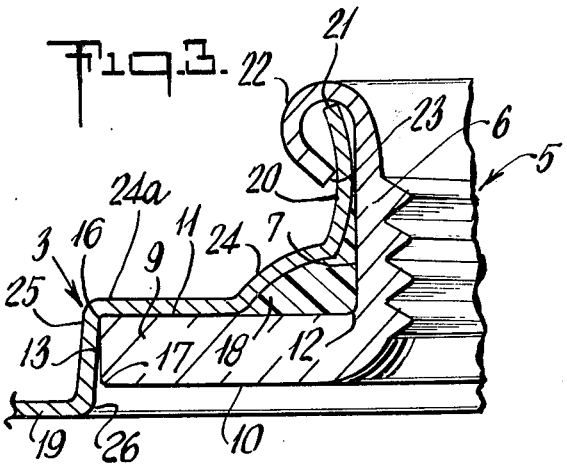
FIG. 3 is an enlarged sectional view taken along lines 3—3 in FIG. 2 and looking in the direction of the arrows.

Insertion of the above described closure flange within a suitably formed opening in a container wall consists of forming the surrounding drum stock 19 into an upwardly drawn neck 20 terminating in a free edge 21. As clearly seen in FIG. 3, the upper unthreaded portion of the flange neck is curled radially outwardly forming a rounded bead 22. The bead 22 encases the upper portion of the drum stock neck bearing against the neck free edge 21 and making contact with the outer surface of the neck as indicated at 23. The upper portion of the drum stock neck 20 is flared radially outwardly due to the positive seating of the neck edge 21 against the interior surface of the bead 22.

Figure 2:
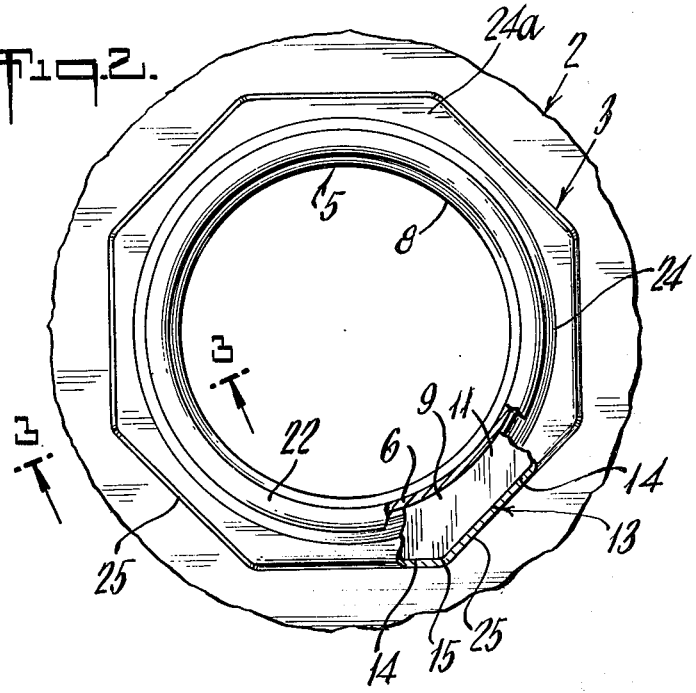
FIG. 2 is a top plan view of the closure construction in accordance with the invention.

The lower end of the neck 20 extends into a laterally extending drum stock embossment commencing with an annular pocket 24 having a convexly contoured exterior surface which tightly confines the gasket 18 within the area immediately adjacent the flange internal corner 12. The drum stock embossment continues radially outwardly in a flattened section 24a closely overlying the flange base 9 and terminates in a downwardly extending octagonally shaped wall 25. The wall 25 is tightly drawn over the upper corner 16 on the flange base and extends substantially vertically below the flange base to the radiused portion 26 where it joins the surrounding laterally extending drum stock 19. Except for a very slight gap adjacent the lower flange base corner 17 due to an unavoidable degree of spring back, the embossment wall 25 tightly hugs the base edge 13 and extends to a point wherein the upper surface of the drum stock 19 is displaced vertically below the flange base lower surface 10. Formation of the drum stock embossment in this manner substantially increases the resistance to relative rotational movement between the flange and drum stock. Optimum results in this regard occur when the vertical displacement between the lower surface 10 of the flange base and the upper surface of the drum stock is approximately twice the thickness of the drum stock metal. As seen in FIG. 2, the slightest rotational movement of the flange base 10 is immediately arrested by embedding of the octagon points 15 in the embossment wall 25. A degree of rigidity is also lent to this torque-resisting engagement by the compressive force exerted on the drum stock neck edge 21 eliminating any vertical free play. Only by severe distortion of the drum stock embossment can the above described torque resistance be overcome.

Another advantage of the closure construction herein described is its relative ability to protect the flange gasket 18 against deterioration as the finished drum undergoes high temperature baking cycles required for drum interior lacquer curing. Confinement of the gasket in a relatively thick cross-section retards breakdown of the gasket resiliency under high heat conditions.

Figure 4:
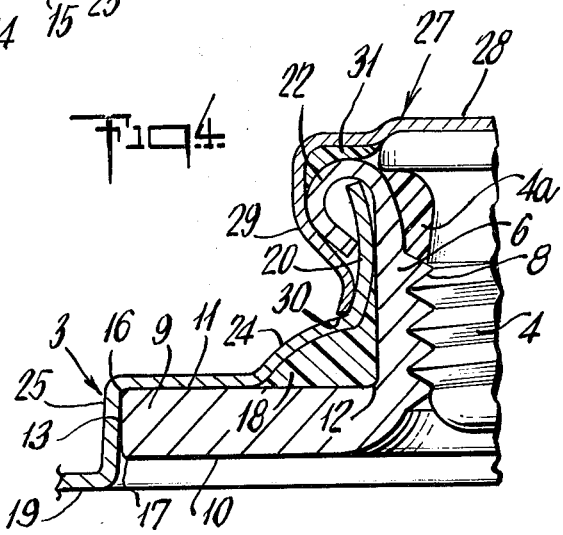
FIG. 4 is a view similar to FIG. 3 with a plug and drum seal included.

A still further advantage can be seen in FIG. 4 wherein the flange 5 is fitted with a closure plug 4 gasketed at 4*a* for sealing against the flange bead 22. In order to afford complete protection against leakage and unauthorized tampering a metal drum seal 27 is applied over the plug 4 and permanently affixed to the underlying drum stock. The seal 27 consists of a top wall 28 from which depends a cylindrical skirt 29 terminating in a lowermost free edge 30. A sealing gasket 31 is positioned within the drum seal at the juncture of the top wall and skirt for engagement against the flange bead 22. The drum seal 27 is applied by crimping the skirt 29 under the flange bead 22 tightly against the drum stock neck 20. With the seal skirt thus formed, it can readily been seen how the previously exposed skirt free edge 30 is effectively shielded by the gasket confining pocket 23 in the drum stock embossment. This particular relationship between the seal skirt edge and the underlying drum stock has the advantage of seriously discouraging any attempts at unauthorized tampering due to the shielding of the skirt edge against the entry of any tamper implement such as a screwdriver.

While the invention has been described in conjunction with polygonally shaped drum closures, it should be noted the invention could be equally well employed in any container or tank closure utilizing a noncircular torque-resisting formation.

Having described my invention, what I claim is as follows:

1. A container closure combination comprising a metal closure flange having an internally threaded upstanding cylindrical neck adapted for reception of a closure plug, a laterally extending noncircular base surrounding the lowermost end of said neck, a resilient sealing gasket tightly surrounding said flange neck and seated on said flange base, said flange being nested within a metal container wall section having an upstanding collar closely surrounding said flange neck, a container wall embossment at the base of said collar having a laterally extending portion overlying said flange base, upwardly curved gasket confining means formed in said laterally extending embossment portion radially outwardly of said collar, said embossment having a polygonal wall depending from said laterally extending portion and extending downwardly adjacent said flange base to a point wherein the upper surface of the container wall section is displaced vertically below the lower surface of the said flange base and an outwardly curled bead at the uppermost end of said flange neck encasing the upper end of said collar.

2. A container closure combination as in claim 1, wherein the extent of said vertical displacement is greater than the container wall metal thickness.

3. A container closure combination as in claim 1, said gasket confining means consists of an annular pocket formed in the laterally extending embossment portion overlying the inner portion of the flange base and having a convexly contoured exterior surface.

4. A container closure combination as in claim 1, wherein the upper end of said container wall collar encased within said flange bead is flared radially outwardly.

* * * * *